US007993166B1

(12) United States Patent
Kline

(10) Patent No.: US 7,993,166 B1
(45) Date of Patent: Aug. 9, 2011

(54) HYBRID MODULAR JACK

(75) Inventor: Richard Scott Kline, Mechanicsburg, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/791,017

(22) Filed: Jun. 1, 2010

(51) Int. Cl.
*H01R 24/00* (2006.01)

(52) U.S. Cl. ..... 439/676

(58) Field of Classification Search ..... 439/676, 439/638

See application file for complete search history.

(56) References Cited

U.S. PATENT DOCUMENTS 6,350,157 B1 * 2/2002 Mizusawa ..... 439/676
7,147,519 B2 * 12/2006 Reichle ..... 439/676
7,326,087 B2 * 2/2008 Gerlach et al. ..... 439/676
7,744,429 B2 * 6/2010 Zhang et al. ..... 439/676
2008/0280500 A1 * 11/2008 Martich ..... 439/676
2010/0159752 A1 * 6/2010 Siev et al. ..... 439/676

* cited by examiner

*Primary Examiner* — Briggitte R Hammond

(74) *Attorney, Agent, or Firm* — Ming Chieh Chang; Wei Te Chung; Andrew C. Cheng

(57) ABSTRACT

A modular jack (100) includes a housing (200), a number of RJ contacts (400) received in the housing (200), and a rotatable spacer (600) positioning the RJ contacts (400). The housing (200) defines a first mating cavity (24) for receiving an electrical plug (120) for establishing electrical connection therebetween. The housing (200) has a first side wall (242), a second side wall (246) opposite to the first side wall (242) and an inner wall (248) defining said first mating cavity (24). The RJ contacts (400) are fastened to the second side wall (246). Each of the RJ contacts (400) has a flexible cantilever contacting portion (42) and a free end (44). The rotatable spacer (600) has a pivot (62) fixed to the second side wall (242), and a comb portion (66) rotatable with the pivot (62) and positioning the free ends (44) of the RJ contacts (400).

20 Claims, 12 Drawing Sheets

HYBRID MODULAR JACK

BACKGROUND OF THE INVENTION

1. Field of the Invention

The present invention relates to a hybrid jack, and particularly, to a hybrid jack that accept an RJ45 cable or an active cable plug.

2. Description of Related Art

U.S. Pat. No. 7,147,519, issued to Reichle on Dec. 12, 2006, discloses a hybrid socket. The socket has a housing comprising recesses and/or through channels. Electrical and/or optical components can be placed in said recesses and/or through channels, in particular optical lines (POFs), mini-coax cables, power supply or control cables, light diodes or components for wireless transmission systems. Said recesses and/or through channels are arranged such that said electrical and/or optical components can be simultaneously used with standard RJ-45 plug connectors to give a universal interface.

An active optical cable plug is disclosed at a web address: http://www.finisar.com/product_Laserwire__109. Finisar's active optical cables accelerate storage, data, and high-performance computing connectivity. Laserwire™ (FCBP110LD1Lxx) targets the 10 GbE, FCoE, FC and proprietary interconnect markets, providing the lowest power and lowest cost option for next generation connectivity.

An object of present invention is to provide a hybrid jack that compatibly accepts a RJ45 cable or an active cable plug.

SUMMARY OF THE INVENTION

An object of the present invention is to provide a modular jack adapted for compatibly mating with either a modular plug or a second plug having a longer inserting depth compared to said modular plug. The modular jack comprises a housing, a plurality of RJ contacts arrayed in the housing, and a plastic spacer positioning the RJ contacts. The housing defines a front face, a first mating cavity in the front face for receiving the RJ-45 plug and a second mating cavity joining with the first mating cavity together for receiving the second plug. The housing has a first side wall, a second side wall opposite to the first side wall, and an inner wall behind the first mating cavity. The second cavity is recessed rearward from the inner wall. The plurality of RJ contacts are arrayed along the second side wall, and has contact portions extending slantwise backwards and free ends continuously extending from the contact portions. The contact portions and the free ends being rotatable around a first line parallel to said front face towards the second side wall. The plastic spacer positions the free ends of said RJ contacts.

Still another object of the present invention is to provide another modular jack. The modular jack comprises a housing, a plurality of RJ contacts and a spacer. The housing has a first side wall, a second side wall opposite to the first side wall, and a rear wall cooperatively defining a first mating cavity. The plurality of RJ contacts mounted relative to the second side wall of the first mating cavity. Each of the RJ contacts has a flexible cantilever contacting portion and a free end. The spacer has a pivot pivotally fixed to the second side wall and a transom portion pivotable about the pivot either to move together with the free ends of the RJ contacts in response to insertion of a first plug or to move and clear the free ends of the RJ contacts in response to insertion of a second plug.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
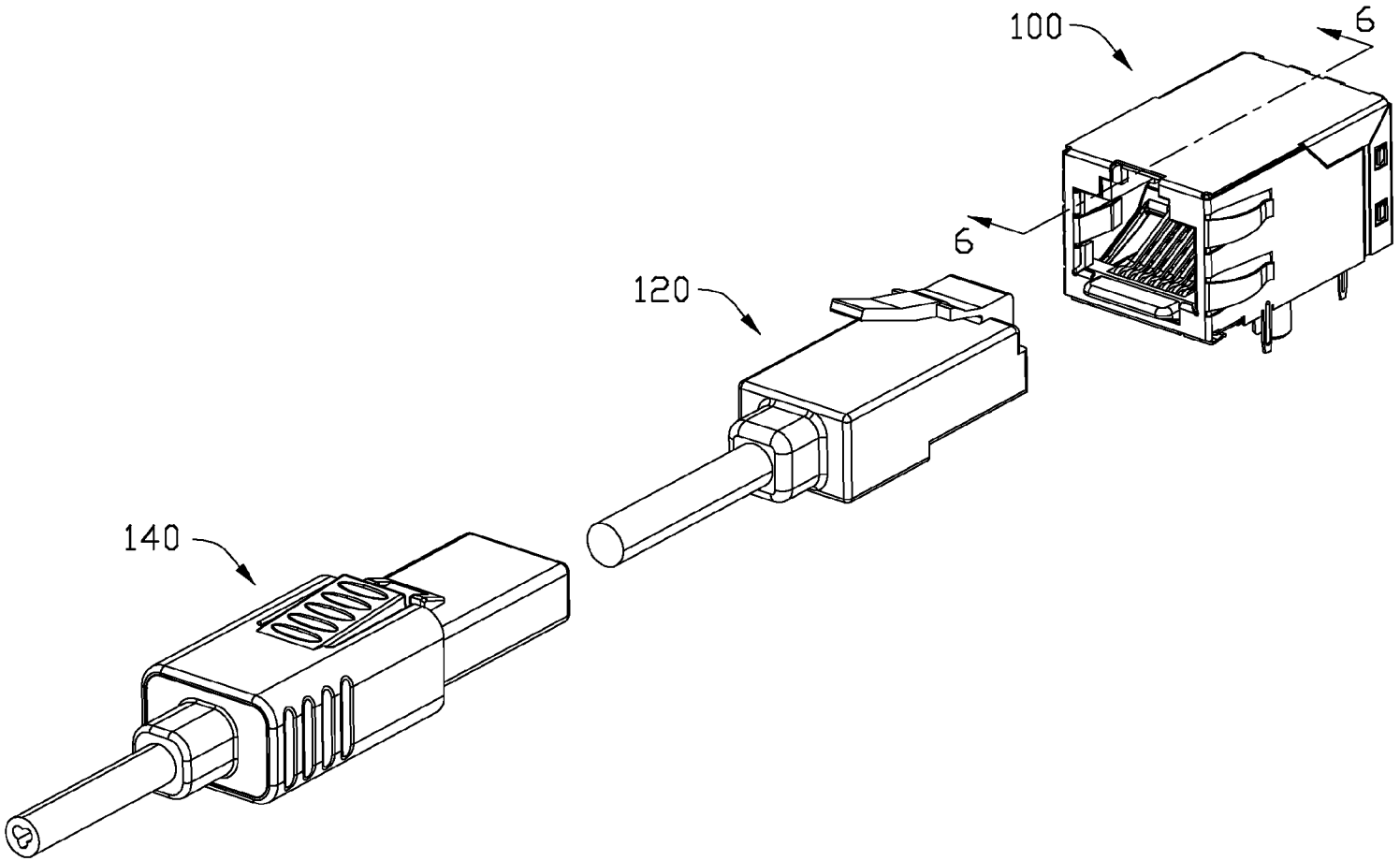
FIG. 1 is a perspective view of a modular jack according to the present invention, a mating RJ-45 plug and an alternative Laserwire cable plug.

Reference will now be made to the drawing figures to describe the present invention in detail.

Figure 2:
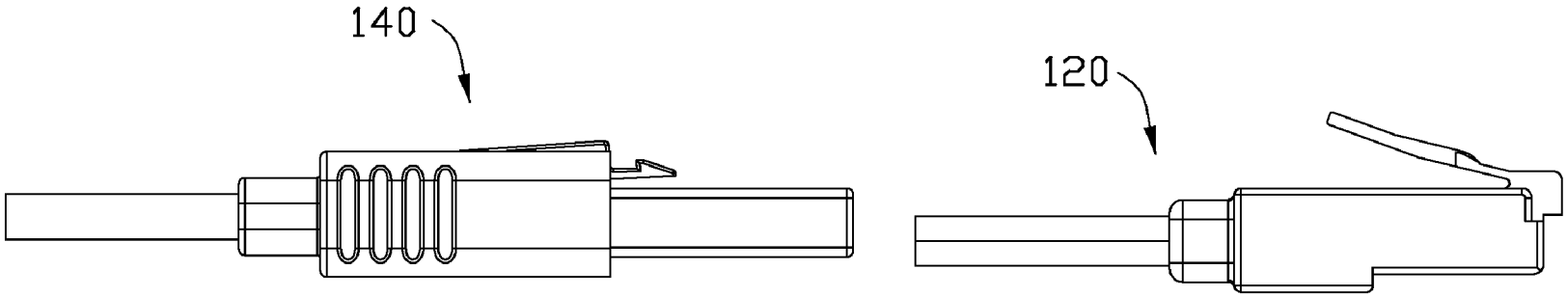
FIG. 2 is a side view of the mating RJ-45 plug and the alternative Laserwire cable plug shown in FIG. 1.
Figure 3:
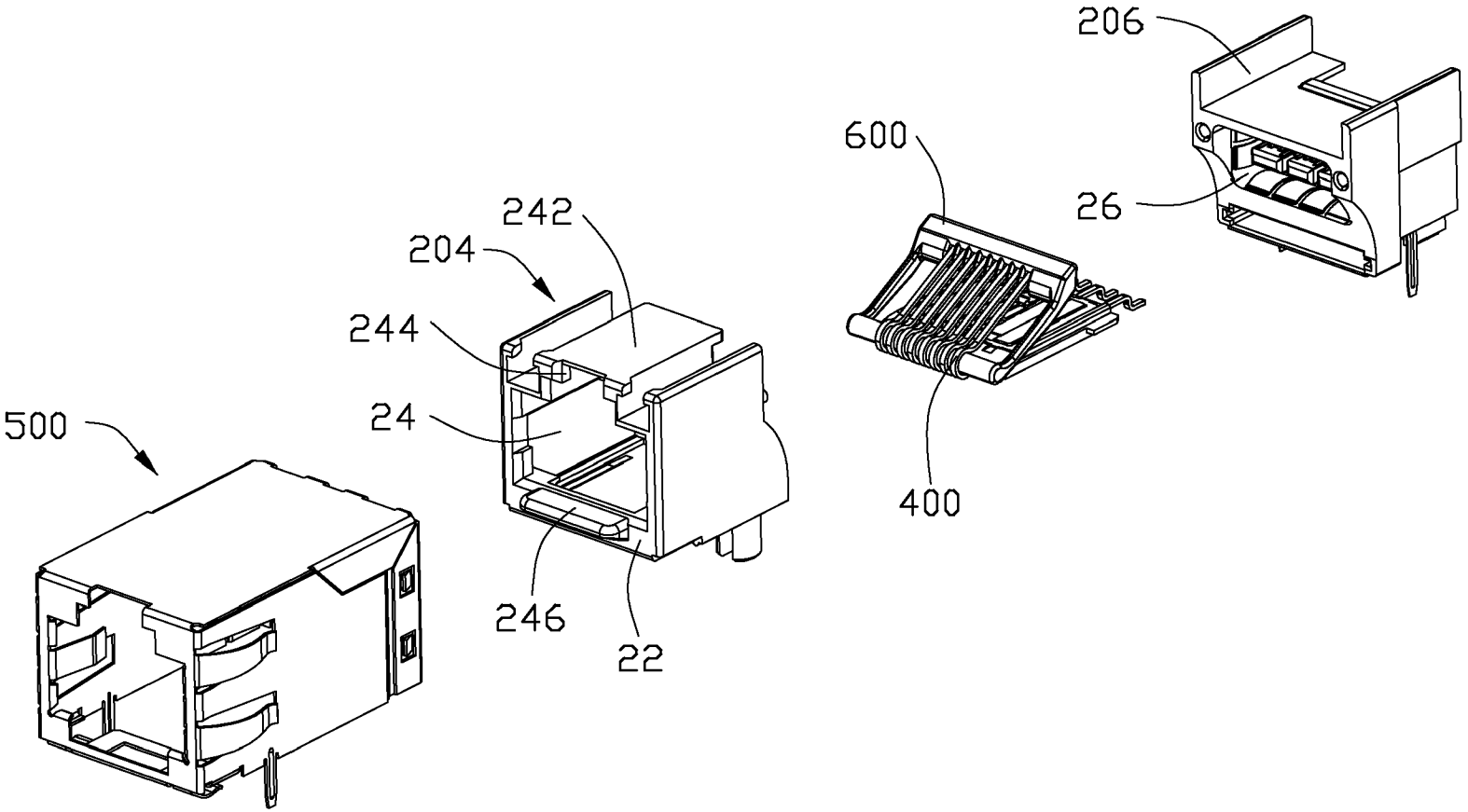
FIG. 3 is an exploded view of the modular jack shown in FIG. 1.
Figure 4:
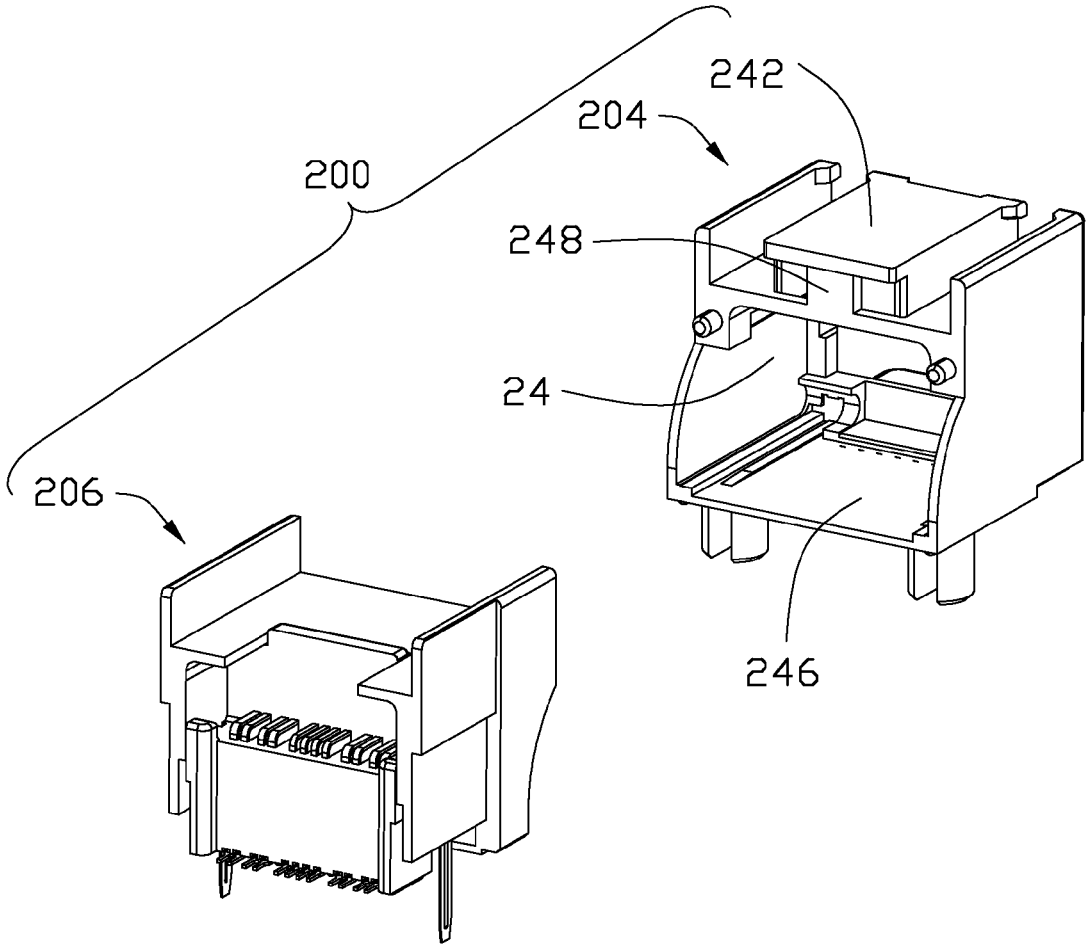
FIG. 4 is a back perspective view of the housing shown in FIG. 3.
Figure 5:
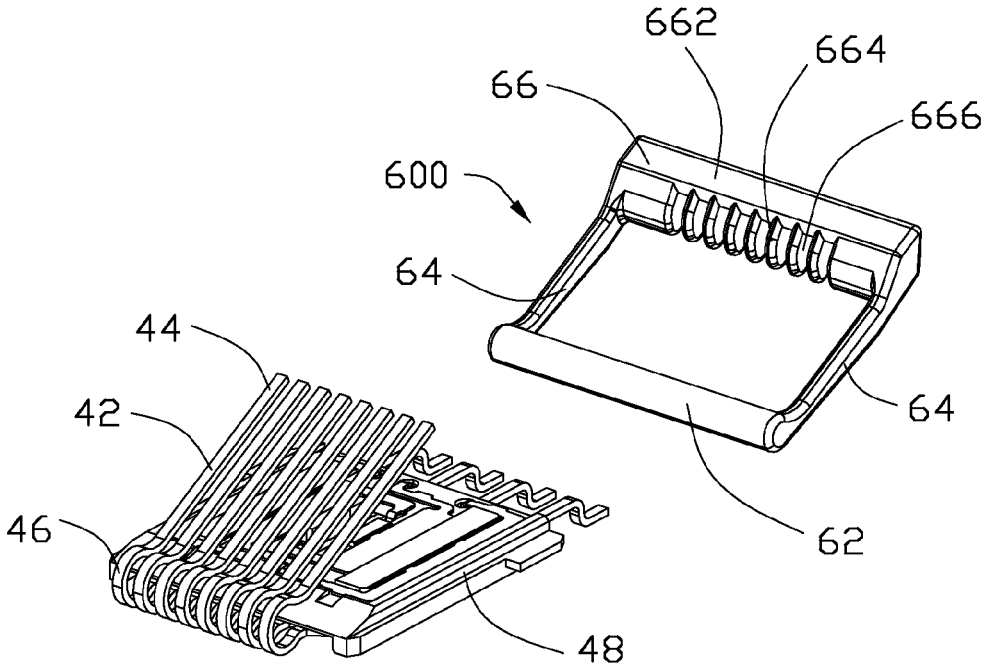
FIG. 5 is a perspective view of RJ contacts, plastic insert and plastic spacer shown in FIG. 3.
Figure 6:
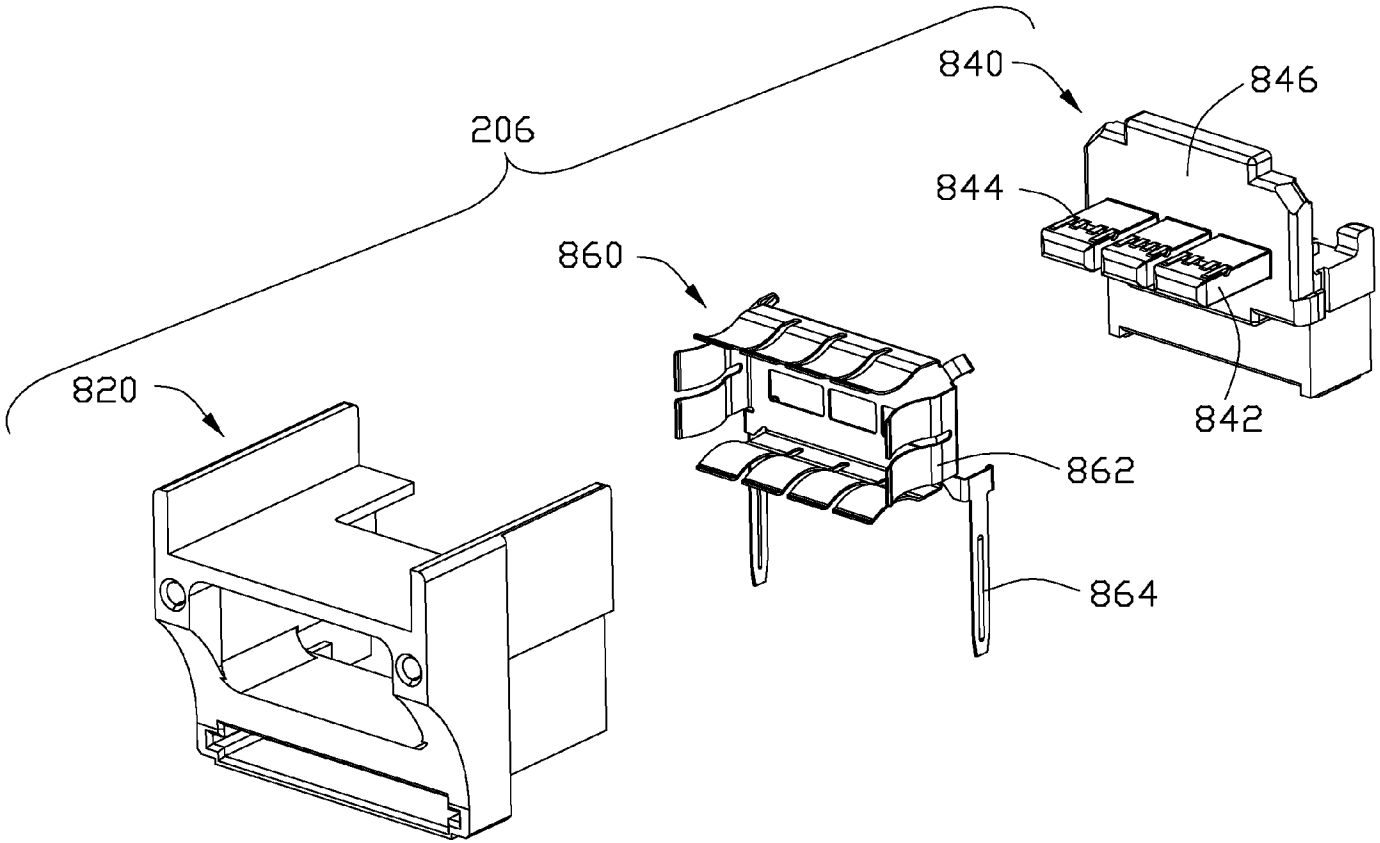
FIG. 6 is an exploded view of the second housing shown in FIG. 3.
Figure 7:
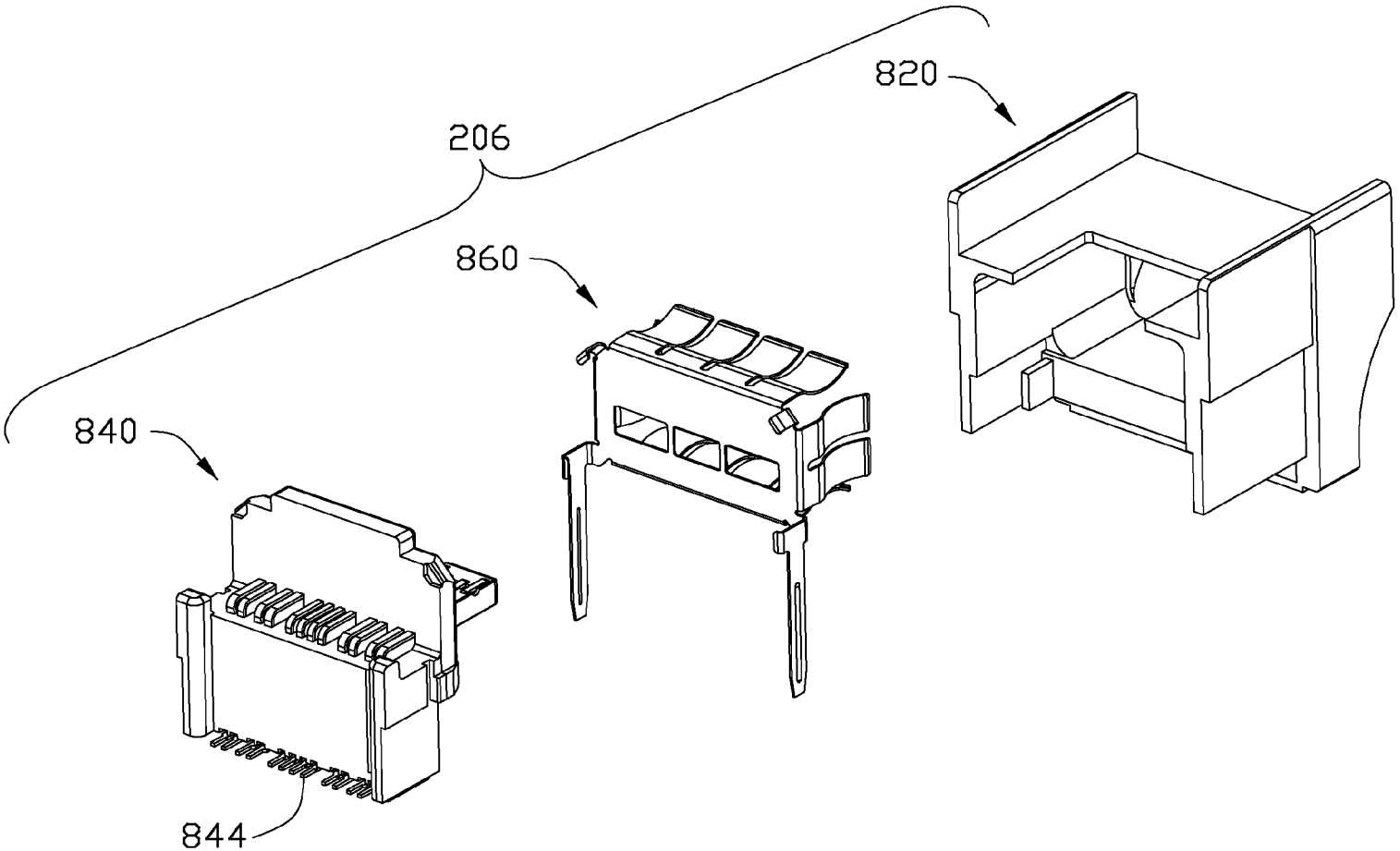
FIG. 7 is an exploded view of the second housing shown in FIG. 3 from a different perspective.
Figure 8:
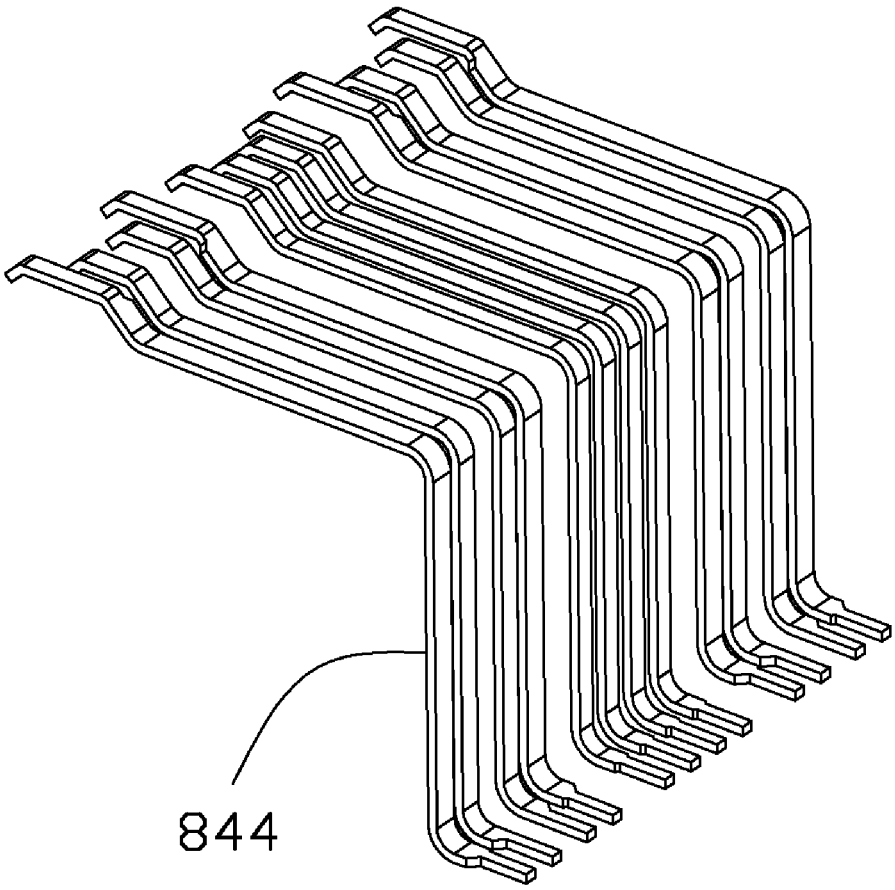
FIG. 8 is a perspective view of the second contacts insert-molded in the second insert assembly shown in FIGS. 6 and 7.
Figure 9:
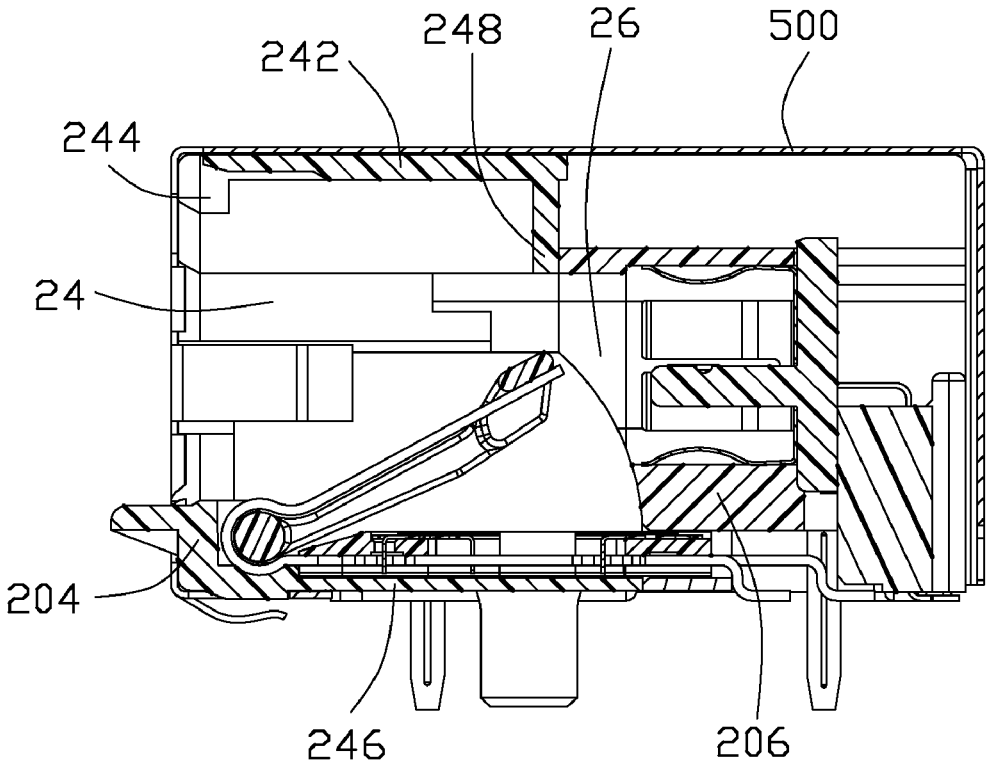
FIG. 9 is a cross-section of the modular jack shown in FIG. 1, taken along the line 9-9.

Referring to FIGS. 1-2, a modular jack 100, to be mounted on a PCB, is adapted for compatibly mating with a RJ-45 plug 120 or a Laserwire cable plug 140. The Laserwire cable plug 140 has a smaller thickness and a longer inserting depth comparing to said RJ-45 plug 120.

Referring to FIGS. 3-9, the modular jack 100 includes a housing 200, a plurality of RJ contacts 400 mounted in the housing 200 and a metal shield 500 shrouding the housing 200.

The housing 200 defines a front face 22, a first mating cavity 24 recessed rearward from the front face 22 for receiving the RJ-45 plug 120 and a second mating cavity 26 joining with the first mating cavity 24 together for receiving the Laserwire cable plug 140. The housing 200 has a first side wall 242 defining a latch 244 for mating with the RJ-45 plug 120 or the Laserwire cable plug 140, a second side wall 246 opposite to the first side wall 244, and an inner wall 248 at a rear end of the first mating cavity 24. The first mating cavity 24 is further recessed rearward from the inner wall 248.

In a preferred embodiment, the housing 200 includes a first housing 204 defining the first mating cavity 24, and a second housing 206 assembled to the first housing 204 and defining the second mating cavity 26. The second housing 206 further includes a second insert 840, a metal piece 860 shrouding a front portion 842 of the second insert 840, and an insulating container 820 receiving the second insert 840 and the metal piece 860. The metal piece 860 includes a sleeve portion 860 for sheathing a front portion of the second plug 140, and two ground pins 864 extending from the sleeve portion. The two ground pins 864 extend out of the insulating container 820 to be mounted into the PCB. The second insert 840 includes a plurality of second contacts 844 and plastic 846 molded over a portion of the second contacts 844.

The plurality of RJ contacts 400 have fastening portions (not shown) insert-molded in a plastic insert 48 and arcuate portions 46 extending forwardly from the fastening portions, contact portions 42 extending backwardly from the arcuate portions 46, and free ends 44 continuously extending from the contact portions 42. The plurality of RJ contacts 400 are arrayed along the second side wall 246 with contact portions 42 extending slantwise backwards. The contact portions 42 and the free ends 44 are rotatable around a first line parallel to said front face.

Figure 10:
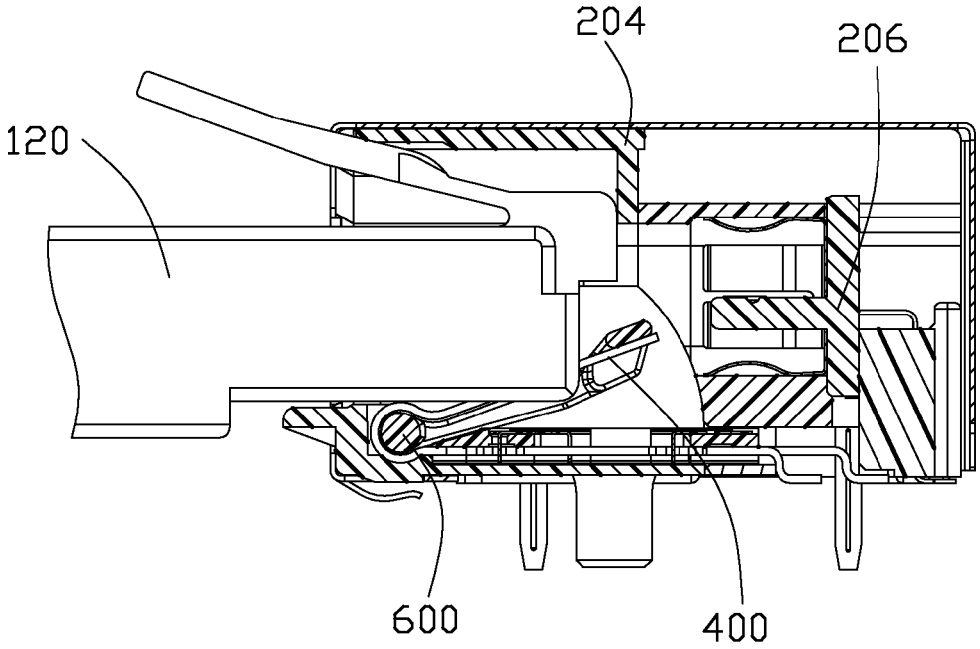
FIG. 10 is a similar cross-section regarding to FIG. 9, except that the RJ-45 plug is inserted into the first mating cavity of the housing.
Figure 11:
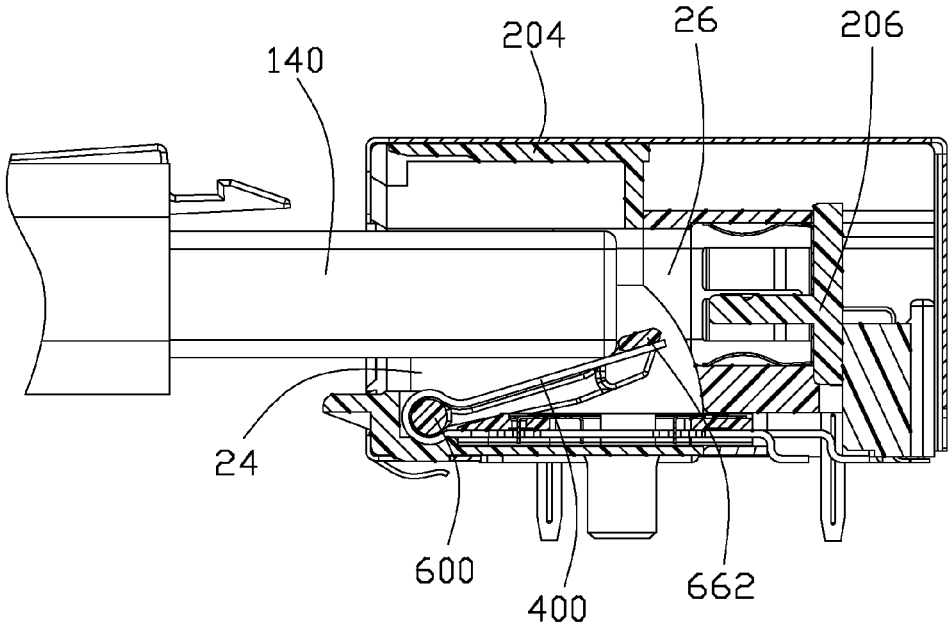
FIG. 11 is a similar cross-section regarding to FIG. 9, except that the Laserwire cable plug is partly inserted into the first mating cavity of the housing.
Figure 12:
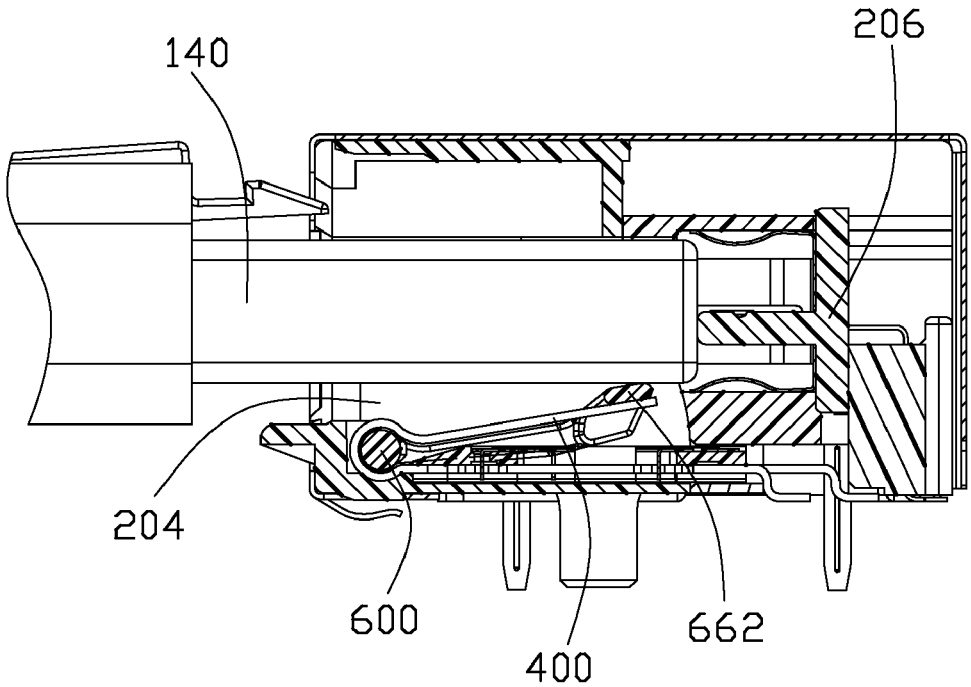
FIG. 12 is a similar cross-section regarding to FIG. 9, except that the Laserwire cable plug is further inserted into the second mating cavity of the housing.

The modular jack 100 further includes a plastic spacer 600 separated from the housing 200. The plastic spacer 600 includes a pivot 62, a comb portion 66 positioning free ends 44 of the RJ contacts 400 and two cantilevers 64 connecting opposite ends of the pivot 62 and the comb portion 66. The pivot 62 is rotatably fitted into a space in the arcuate portions 46. The plurality of RJ contacts 400 together with the plastic insert 48 and the plastic spacer 600 are inserted into the first housing 204 and secured to the second side wall 246. Thus the spacer 600 is indirectly and rotatably fixed to the second side wall 246 of the housing 200 at the same time. It should be understood that in alternatively embodiment, the spacer 600 could be directly and rotatably fixed to the second side wall 246 of the housing 200. The comb portion 66 has a cam portion 662 and a plurality of teeth 664 extending towards the second side wall 246 from the cam portion 662. The teeth 664 defines a plurality of slots 666 therebetween receiving corresponding free ends 44 of the RJ contacts 400 therein. The spacer 600 is so configured that (1) when modular jack 100 is unmated, the cam portion 662 preloads the free ends 44 of the RJ contacts 400 (shown in FIG. 9); (2) when the RJ-45 plug 120 is inserted into the housing 200, the RJ-45 plug 120 directly contacts the contact portions 42 of the RJ contacts 400 (shown in FIG. 10); and (3) when the Laserwire cable plug 140 is inserted into the housing 200, the Laserwire cable plug 140 firstly contacts the contact portions of the RJ contacts 400, secondly slides along the cantilevers 64 and over the comb portion 66, thereby rotating the contact portions 42 (shown in FIG. 11), and (4) when the Laserwire cable plug 140 is further inserted into the second mating cavity 26, the contact portions 42 are kept isolated from the Laserwire cable plug 140 by the cam portion 662 (shown in FIG. 12). Understandably, in an alternative embodiment, an additional resilient device may be optionally provided under the spacer 600 to strengthen the restoration force thereof in addition to that provided by the contact portions 42.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack, adapted for compatibly mating with either a modular plug or a second plug having a longer inserting depth compared to said modular plug, comprising:

a housing defining a front face, a first mating cavity recessed rearward from the front face for receiving the modular plug, and a second mating cavity joining with the first mating cavity together for receiving the second plug, the housing having a first side wall and a second side wall at opposite sides of the first mating cavity, and an inner wall behind the first mating cavity, the second mating cavity recessed rearward from the inner wall;

a plurality of RJ contacts arrayed along the second side wall and having contact portions extending slantwise backwards and free ends continuing the contact portions, the contact portions and the free ends being pivotable around a first line parallel to said front face towards the second side wall; and a plastic spacer positioning the free ends of said RJ contacts.

2. A modular jack as claimed in claim 1, wherein said plastic spacer is separate from the housing and movable together with the free ends of said RJ contacts.

3. A modular jack as claimed in claim 2, wherein the plastic spacer is pivotally mounted relative to the second side wall of the first mating cavity and defines a plurality of passageways respectively receiving said free end of the RJ contacts.

4. A modular jack as claimed in claim 1, wherein said plurality of RJ contacts have fastening portions insert-molded in a plastic insert and arcuate portions extending forwardly from the fastening portions, the contact portions extending backwardly from the arcuate portions.

5. A modular jack as claimed in claim 4, wherein said plastic spacer comprises a pivot received in a space defined by the arcuate portions and two cantilevers connected at two opposite ends of the pivot, and a positioning portion connected between the two cantilevers.

6. A modular jack as claimed in claim 5, wherein said positioning portion has a cam portion and a plurality of teeth extending towards the second side wall from the cam portion and defining a plurality of slots therebetween receiving corresponding free ends of the RJ contacts.

7. A modular jack as claimed in claim 6, wherein said spacer is so configured that (1) when a modular plug is inserted into the first mating cavity of the housing, the modular plug directly contacts the RJ contacts, (2) when the second plug is inserted into the first mating cavity of housing, the second plug pushes the spacer, the spacer driving the contact portions to rotate towards the second side wall, and (3) when the second plug is further inserted, the second plug slides over the cam portion and is cleared from the free ends of the RJ contacts by the cam portion.

8. A modular jack as claimed in claim 1, wherein the housing comprises a first housing defining the first mating cavity, and a second housing assembled to the first housing and delineating the first and second mating cavities.

9. A modular jack as claimed in claim 8, further comprising a metal piece mounted in the second mating cavity, the metal piece having a connecting pin extending out of the second housing.

10. A modular jack as claimed in claim 9, wherein the metal piece comprises a sleeve portion for sheathing a front portion of the second plug, the connecting pin extending from the sleeve portion.

11. A modular jack as claimed in claim 1, wherein said first side wall has a latch mechanism for engaging the modular plug or the second plug.

12. A modular jack comprising:

a housing having a first side wall, a second side wall opposite to the first side wall, and a rear wall together defining a first mating cavity;

a plurality of RJ contacts mounted relative to the second side wall of the first mating cavity, each of the RJ contacts having a flexible cantilever contacting portion and a free end;

a spacer having a pivot pivotally mounted relative to the second side wall and a transom portion pivotable about the pivot either to move together with the free ends of the RJ contacts in response to insertion of a first plug or to move and clear the free ends of the RJ contacts in response to insertion of a second plug.

13. A modular jack as claimed in claim 12, wherein a second mating cavity is recessed rearward from the inner wall, the second mating cavity joining with the first mating cavity together for receiving the second plug.

14. A modular jack as claimed in claim 13, wherein said plurality of RJ contacts have fastening portions insert-molded in a plastic insert, and arcuate portions extending forwardly from the fastening portions, the contact portions continuously extending rearward from the arcuate portions, said pivot being received in a space defined in the arcuate portions.

15. A modular jack as claimed in claim 14, wherein said transom portion has a cam portion and a plurality of teeth extending towards the second side wall and defining a plurality of slots therebetween receiving corresponding free ends of the RJ contacts.

16. A modular jack as claimed in claim 13, wherein the housing comprises a first housing defining the first mating cavity, and a second housing assembled to the first housing and defining the second mating cavity.

17. A hybrid connector for selectively use with first and second plugs in a mutually exclusive manner, comprising:

a housing unit defining a first mating cavity communicating forwardly with an exterior through a front opening;

a latch structure formed in the front opening and adapted to latch at least one of said first and second plugs;

a second mating cavity formed behind and essentially aligned with the first mating cavity in a front-to-back direction;

a first terminal set having a plurality of first contacts thereon and located around the first mating cavity; and a second terminal set having a plurality of second contacts thereon and located around the second mating cavity; wherein the first terminal set invades the first mating cavity and is adapted to be relatively less deflected by the first plug for coupling consideration during insertion of the first plug into the first mating cavity via the front opening for mating with the first terminal set, while being adapted to be relatively more deflected by the second plug for unblocking consideration during insertion of the second plug into the second mating cavity via both the front opening and the first mating cavity for mating with the second terminal set.

18. The hybrid connector as claimed in claim 17, wherein said latch structure is adapted to latch the first plug and is also adapted to latch second plug in said mutually exclusive manner.

19. The hybrid connector as claimed in claim 17, wherein the first terminal set is equipped with an insulative spacer pivotally moved relative to the housing unit.

20. The hybrid connector as claimed in claim 19, wherein when mating with the second plug, only the spacer engages the second plug while the first contacts not for assuring no unexpected electrical coupling occurs between the first contacts and the second plug.

* * * * *